United States Patent [19]

Jackson et al.

[11] Patent Number: 4,726,846

[45] Date of Patent: Feb. 23, 1988

[54] METHOD OF RECLAIMING WASTE FIBER REINFORCED ASPHALT SHEET MATERIAL AND RECLAIMED PRODUCTS OF SUCH WASTE

[75] Inventors: James W. Jackson, East Walpole; Cecil E. Stapley, Holliston, both of Mass.; Franklin W. Wood, Canby, Oreg.

[73] Assignee: Bird Incorporated, E. Walpole, Mass.

[21] Appl. No.: 856,031

[22] Filed: Apr. 25, 1986

[51] Int. Cl.[4] ..... C08L 95/00

[52] U.S. Cl. ..... 106/281 R; 521/40; 521/45.5

[58] Field of Search ..... 106/281 R, 273; 521/45.5, 40; 366/53

[56] References Cited

U.S. PATENT DOCUMENTS

| | | | |
|---|---|---|---|
| 1,732,281 | 10/1929 | Robinson | 106/282 |
| 2,368,371 | 1/1945 | Minge et al. | 106/273 |
| 2,970,779 | 2/1961 | Duty | 241/101 |
| 3,260,610 | 7/1966 | Balak | 106/283 |
| 3,610,585 | 10/1971 | MacLeod et al. | 259/6 |
| 3,886,021 | 5/1975 | Breckenfelder | 156/246 |
| 4,325,641 | 4/1982 | Babus et al. | 366/18 |

OTHER PUBLICATIONS

Farrell Machinery Group USM Corporation Banbury Mixers Bulletin 215C, published more than one year prior to the filing date of the present application.

Bulletin of Inoue Seisakusho (Mfg) Co., Ltd., Kneaders, published more than one year prior to the filing date of the present application.

*Primary Examiner*—Amelia Burgess Yarbrough

[57] ABSTRACT

A method for reclaiming waste asphalt sheet material reinforced with inelastic brittle fibers, such as fiberglass, subjects the material to tearing, kneading, sheet and frictional drag forces, preferably in a kneading mixer, to reduce the material to a viscous fluid state in which the fibers have been pulverized to particles of a maximum dimension less than about 600 microns. If mineral particles of larger dimension are present in the reduced fluid material, they are crushed to filler particles of maximum dimension less than about 600 microns by passing the reduced fluid material between oppositely rotated, heated crush rolls. The novel reclaimed waste includes at least the asphalt and the pulverized fiber, may include mineral filler of maximum particle size less than 600 microns, some or all of which may be crushed mineral granules of larger maximum dimension contained in the waste material.

14 Claims, 5 Drawing Figures

METHOD OF RECLAIMING WASTE FIBER REINFORCED ASPHALT SHEET MATERIAL AND RECLAIMED PRODUCTS OF SUCH WASTE

BACKGROUND OF THE INVENTION

This invention relates to methods of reclaiming waste fiber-reinforced asphalt sheet material, especially roofing such as shingles and built-up roofing material, and to reclaimed products of such waste. More particularly, the methods of the invention are applicable to the reclaiming of waste of which the fibers are inelastic and brittle, such as from fiberglass mat which currently is nearly exclusively the reinforcing base for asphalt sheet roofing produced in the United States. The products are produced from waste having its fiber content of this character and are useful in conventional processes of manufacture of the parent material from which the waste is derived.

In the last two decades, the composition of roofing, particularly shingles, has undergone substantial change, due to a variety of factors such as improvement of quality and durability, the escalating cost of asphalt, and the requirements of modern, high speed manufacturing machines. The paper or mat of organic fiber, usually cellulose, previously used for impregnation by the asphalt, has been replaced by most manufacturers with a mat of glass fibers and the amount of asphalt used has been reduced from more than 50 by weight to less than 25% by weight. This reduction was partly made possible by the non-porosity of the glass fibers versus porosity of the organic fibers. The organic fibers needed a low melting point asphalt saturant which they could absorb to prevent cellulose moisture uptake, in addition to the higher melting point asphalt needed for product coating and strength in both the former and present products. The amount of mineral filler has been substantially increased in the fiberglass reinforced product, with attendant more rigid size and material specifications.

When used roofing is included, the yearly tonnage of waste roofing is enormous. Roofing using glass fibers has not been on the market extensively for more than its normal life cycle, so that used roofing is still largely of the older, organic fiber type. Immediately of more importance to modern roofing manufacture is what to do about waste produced in manufacture. Waste in roofing manufacture, occurring mainly in the cutting of shingles, runs about five percent of the tonnage of saleable product, a significant factor when it is considered that about 75% of manufacturing cost is that of materials used. Added to this is the considerable cost of disposal.

With increasing pressures of ecology, acceptable landfill sites for dumping are limited and incinerating has become dubious. In addition, trucking to site is expensive. Waste shingles have been used to some extent as a substitute for some of the asphalt in road paving, but the economics are such that usually not even trucking cost will be paid for the waste. Processes are known or under development for solvent extraction of the asphalt, but the economics of such processes are doubtful, particularly applied to glass-fibered waste with its lower asphalt content than the organic fibered product.

Methods have been proposed for reclaiming whole roofing manufacture waste, which are said to produce a reclaimed product useful in new roofing manufacture. U.S. Pat. No. 1,732,281 discloses such a method in which small pieces of the roofing of the then organic fiber type are subjected to the shearing action of alternate rotary and fixed knives, which break up the fiber mat and distribute the fiber and filler throughout the asphalt. The product is said to be useful as a molding compound, which sets to a rigid state and may be used as the core of special, molded shingles. U.S. Pat. No. 2,368,371 subjects roofing manufacture waste of the organic fiber type to the successive action of three hammermills, combines fractions from each mill and agitates the mix in hot asphalt. The process is said to disintegrate the fibrous material "into fine fibers or fibrillas". While the product is said to be useful in the production of asphalt products such as shingles, no details of a suitable manufacturing process are indicated.

Despite any suggestions of the prior art, we are aware of no manufacture of roofing which recycles 100% of the waste produced therein, it is believed because no method has been known by which all the components of the waste could be rendered suitable to meet the specifications for materials that can be satisfactorily used in the manufacturing process. There is a great and ever more pressing need for an economical method of treating roofing manufacture waste to provide products meeting all specifications for use in the manufacturing process.

SUMMARY OF THE INVENTION

Studies preliminary to the invention led to the conclusion that no method of reclaiming roofing waste would be acceptable, for recycling of the product in the manufacturing process, if the fibrous content was left in a form recognizable as fibers which, by nature, tend to tangle forming unacceptable clumps and, more importantly if in fibrous form, provide pathways for water through the asphaltic coating, drastically reducing the main function of the roofing material, water protection. It was determined that the fiber content must be reduced to a particulate state of maximum dimension at least as small as the maximum dimension filler particle specification for the manufactured product. Hammermill tests on fiberglass reinforced roofing only confirmed that these fibers, like the organic fibers of the waste used in U.S. Pat. No. 2,368,371 above referred to, were not reduced to nearly the desired particulate state.

After various other fruitless investigations, it was decided to determine whether a kneading force, such as is applied by a kneading type mixer, would have a beneficial effect. Such a mixer was tested on waste shingles of the fiberglass-reinforced type. It was surprisingly found that, with temperature controlled to maintain the asphalt near its melting point in a flowable viscous state, the glass fiber content could be pulverized to particulate dust even finer than the maximum mineral filler particle dimension of the waste, which, as usual, was about 0.024 inches (600 microns). In fact, the fiber could be readily reduced to a maximum dimension less than 0.012 inches (300 microns) or even less than 0.006 inches (149 microns).

A kneading type mixer is a batch type machine which has parallel rotors oppositely rotated and equipped with spiral blades which may or may not overlap in the space between them, which the blades alternately traverse. These rotors force the material against a cutting anvil which supplies shear force to reduce the feed material to small size, then squeezes the material against the interior wall of the housing generating frictional drag shear forces and returns it to the space between the rotors, forcing some of it into the path of the blade of the other rotor to be picked up and subjected to kneading force between the blades, as in a bread mixer. It has been used for many years as a machine for preparing material mixes for processing, but never, so far as can be ascertained, for reclaiming fiber reinforced asphalt sheet material. Such machines are available commercially from two principal sources, Farrel Company Division USM Corporation, Ansonia, Connecticut, 06401, U.S.A., and Inoue Seisakusho (MFG) Co., LTD., 58, Shirane, Isehara City, Kanagawa, Japan 259-11.

While the combination of kneading, shearing, and frictional drag forces as in a kneading type mixer provides the desired pulverization of glass fibers, all attempts to obtain such results with the older, organic type fiber reinforced roofing have failed. It appears evident that the difference in fiber characteristics is controlling, and that the mixer has its discovered utility only where the fiber portion of the waste has inelastic, brittle characteristics such as those of fiberglass, not if it has the relative elasticity and resistance to disruption of cellulose and like organic fiber.

The kneader type mixer, however, is not capable of breaking down materially the large mineral surfacing granules used on shingles. Hence, while the process of the invention can be fully carried out in a kneading type mixer for reclaiming roofing such as built-up roofing, which does not have large surfacing granules, additional treatment is necessary with shingles, to break the surfacing granules down to the maximum particle size of the filler used in the manufacture of the shingles.

It has been discovered that such breakdown of the surfacing particles can be accomplished by passing the flowable mixer product between oppositely rotating, heated pressure rollers having a minimum clearance equal to the desired maximum particle dimension. In this manner, the granules are pulverized to meet the filler specification and yet without significant scoring and wear of the roller surfaces, as would be expected if it were attempted to crush granules per se between rollers, the asphalt providing sufficient lubrication to prevent this. Surprisingly, observation indicates that the hydraulic forces, produced by the asphalt surrounding the granules as the material flows through the roll nip, dramatically increase the granule crushing effectiveness of the pressure rolls, as the size of the processed granules is smaller than would be expected by the nip opening.

Thus the invention provides a method of reclaiming waste asphalt sheet material reinforced with inelastic, brittle fibers such as fiberglass, which subjects the material to tearing, kneading, shear and frictional drag forces at a temperature and for a time sufficient to reduce the material to a viscous fluid state in which the fibers have been pulverized to particles of a maximum dimension of less than about 0.024 inches (600 microns). These forces are preferably provided by a kneading type mixer. When the waste includes surfacing mineral granules, the method includes the further subsequent steps of feeding the fluid material into the nip between opposed, heated rollers having a minimum clearance of about 0.024 inches (600 microns) or less, and oppositely rotating the rollers to force the material through the minimum clearance to reduce the granules to a maximum dimension approximately equal to the minimum clearance.

Products of the invention are reclaimed waste of asphalt sheet material reinforced with inelastic, brittle fibers such as fiberglass, in which the fibers have been pulverized to a maximum particle dimension less than about 0.024 inches (600 microns). Where the waste contained mineral granules, these have also been pulverized to a maximum particle dimension less than about 0.024 inches (600 microns). The recovered waste product can be mixed with further asphalt and 100% re-used in the product-forming mix of the manufacturing process of the parent roofing of the waste. The reclaimed waste differs from the composition of the mat coating of the parent roofing only in that it contains pulverized brittle fiber particles as a percentage of its mineral filler makeup.

DESCRIPTION OF THE PREFERRED EMBODIMENTS

Figure 1:
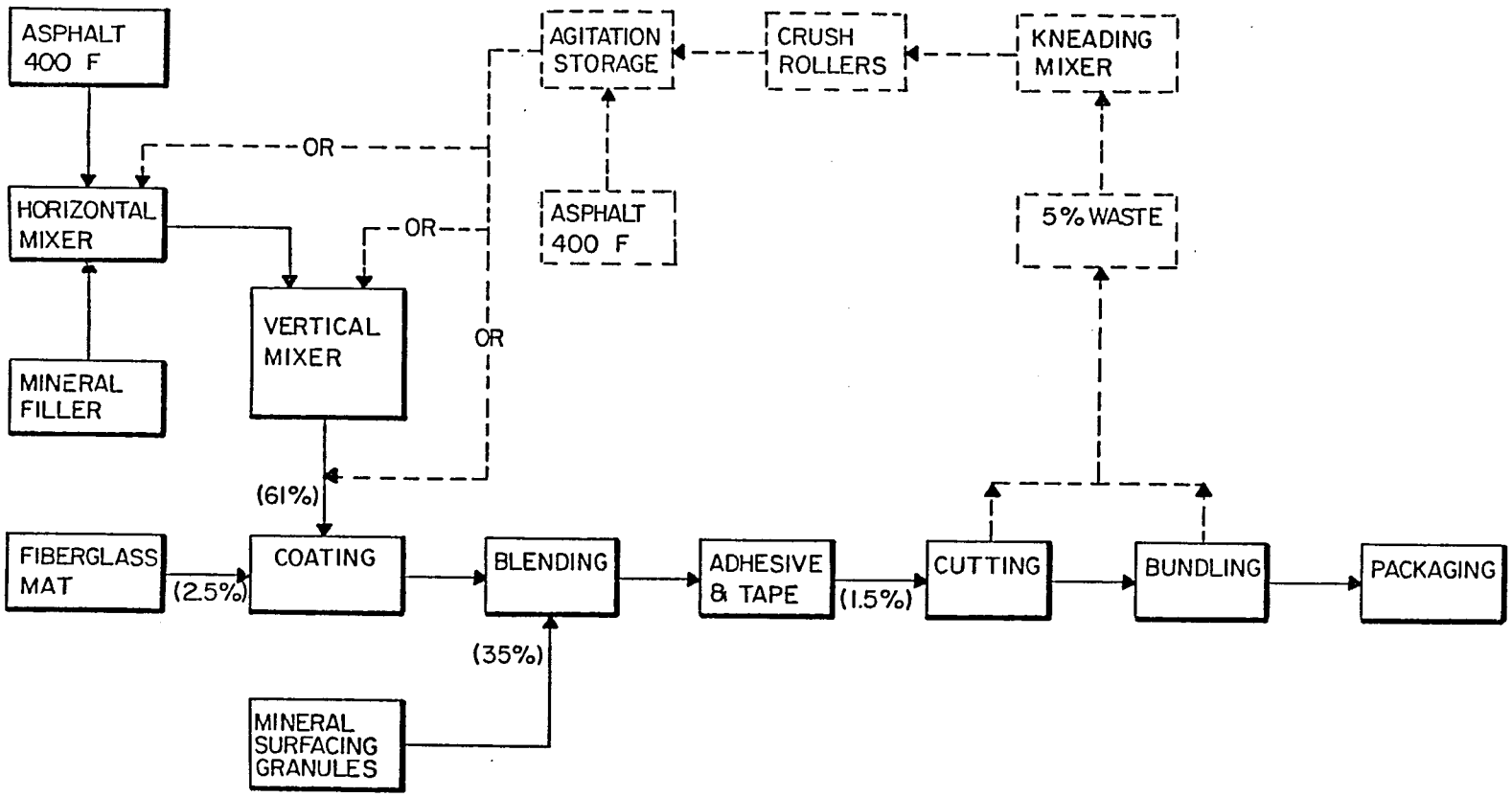
FIG. 1 is a flow sheet of a typical shingle manufacturing process with a waste reclaim and recycle section according to the invention shown in dashed lines.

FIG. 1 of the drawings shows in full lines a box flow diagram of a typical present day fiberglass reinforced shingle manufacturing process, to which has been added in dashed lines a waste reclaim and recycle section according to the invention.

In the manufacturing process, a horizontal mixer at the upper left is supplied with asphalt at 400° F. and mineral filler from so-labeled sources, in relative proportions about 2 parts by weight filler to 1 part by weight of asphalt. The filler particles are of maximum dimension less than about 0.024 inches (600 microns) (e.g., 100% will pass a screen with 0.024 inches (600 microns) square mesh). The asphalt has a melting point of about 220° F. The horizontal mixer output is to a vertical mixer, the output of which (including waste recycle) is to the coating section of the roofing-making machinery and consititutes about 61% of the weight of the finished product.

In the coating section the filled asphalt is applied to the upper and lower surfaces of a fiberglass mat, the mat typically being a non-woven web of about 1 inch (25.4 mm) long glass fiber unwound from a roll and constituting about 2.5% by weight of the finished product. The sheet is then fed to a blending machinery section in which mineral surfacing granules are blended into its upper face (exposed face of the shingles when used). The surfacing granules constitute about 35% by weight of the final product and are of relatively large size compared to the filler particles (e.g., 50% greater maximum dimension than 0.03 inches (850 microns)).

The granule-surfaced sheet material then passes to an adhesive and tape section in which wind-seal adhesive is applied in appropriate locations and a strip of polyester reinforcing release tape about 1.5 inches (38 mm) wide is applied to the non-granule-surfaced side of the material, in position to lie at the base of cut-outs in the final cut shingle. The adhesive and tape account for the final about 1.5% of the weight of the finished product. The material then passes through a cutting stage in which the material is cut into shingles, a bundling stage in which the shingles are inspected and bundled, to the final stage of packaging the bundled shingles.

Referring now to the dashed line waste recovery section, it is assumed that the manufacturing process produces an average of 5% waste (tonnage). This is indicated as coming mainly from the cutting and bundling operations as cutting fragments and defective product rejected by inspection. The reinforcing tape need not be removed since it, and the wind-seal adhesive, are so finely disintegrated and amalgamated into the asphalt in the kneading mixer as to be undetectable and of no significance in the reclaimed product. This collected waste, freed of any foreign matter such as metal ties or paper packaging, is fed to a kneading mixer which is capable of receiving it in sheet, roll, bundles or piece form.

In the kneading mixer, the waste is reduced to a viscous fluid state in which the glass fibers of the mat have been pulverized to particles of maximum dimension at least as small, usually smaller, than the maximum particle dimension of the mineral filler content of the parent product and the waste. The mixer has little effect on the size of the surfacing granules or filler particles, so that the only change in the content of the waste effected by the kneading mixer is to convert the 2.5% by weight glass fiber mat content into 2.5% by weight of additional filler of glass fiber particles. From the kneading mixer the waste product is fed between crush rollers, which crush the surface granules into mineral filler particles of essentially the same maximum dimension as that of the external source mineral filler used in the product manufacture.

Thus the product leaving the crush rollers is the same as that produced in the horizontal mixer of the parent shingle manufacturing process except that it has approximately twice as much filler, an added 35% by weight of the mineral filler resulting from crushing of the surfacing granules, plus 2.5% by weight of the pulverized glass fibers. To bring the reclaimed waste to equality with the horizontal mixer product of the manufacturing process, the product is fed from the crush rollers to an agitation storage stage in which enough asphalt, at 400° F. or slightly higher, is added to make the filler-to-asphalt ratio approximately the same as in the untreated waste, and to bring the reclaimed product to the same temperature and viscosity as the horizontal and vertical mixer product.

The agitation storage stage provides agitation to keep the product fully mixed and enough storage capacity to insure continuous output in the quantity required. In this regard, while the kneader-mixer has a batch output on the order of every 1.5 to 5 minutes, the crush rollers are operated continuously to process each batch in slightly less than the batch time interval of the kneading mixer, so that the input to the agitation storage stage is substantially continuous. The product from the agitation storage can be added to the manufacturing process stream optionally at the horizontal mixer or vertical mixer or at the output of the latter to the laminating stage, as indicated by the three alternative dash flow lines labeled "or" in FIG. 1.

Thus, the product of the manufacturing process plus 5% waste reclaim and recycle is the same as the product would be without the recycle except that about 0.1% by weight of this new mixture (created from 2.5% of the recycle stream) is pulverized glass particle filler instead of mineral particle filler. While this is a small weight percentage, being about 0.5% by weight of the asphalt present, it is recognized that, because of bulk density difference between the glass and the mineral particles, the glass particles are a larger percentage by volume of the product. Extensive testing has been carried out which indicates that the volume of glass particles present has no adverse effect, such as viscosity increasing, during manufacture, or in the finished product. The pulverized glass appears to be an entirely acceptable substitute for pulverized minerals in the relative quantities concerned.

Direct recycle such as shown in FIG. 1 is believed at present to be the most advantageous use of the invention but there are various alternatives. Instead of direct recycle, the product from the crush rollers may be calendered to thicker sheet form and cooled for storage, for later hot asphalt addition and use. The waste from a given manufacturing process may be supplemented or replaced by similar waste from other sources.

Figure 2:
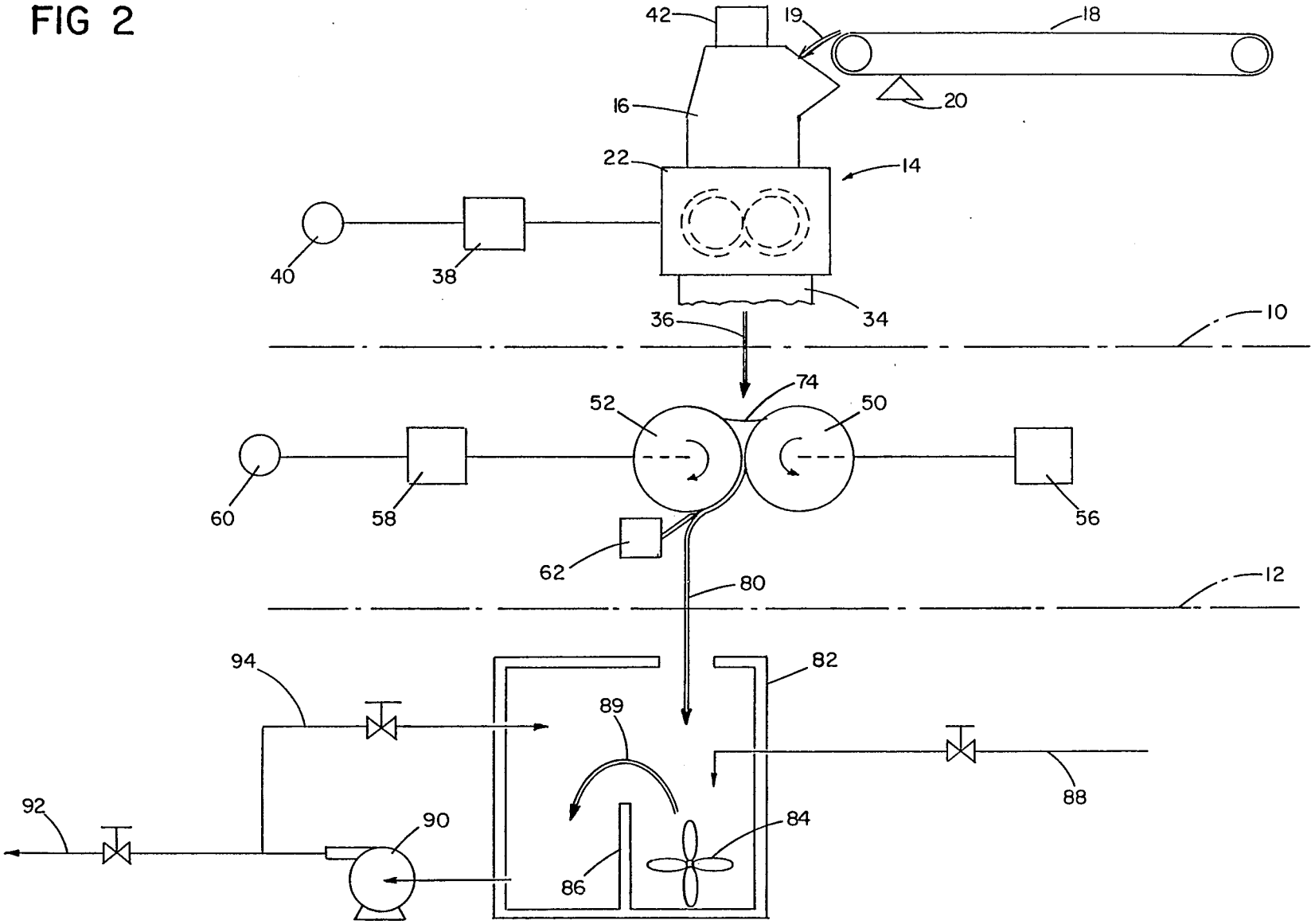
FIG. 2 is a diagrammatic apparatus implementation of the waste reclaim and recycle section of FIG. 1.

FIG. 2 of the drawing diagrammatically shows an apparatus implementation of the waste reclaim and recycle section of FIG. 1. The three stages shown in horizontal alignment at the top of FIG. 1 are, in the implementation, more conveniently arranged in vertical succession, separated by the dash lines 10 and 12; with the kneading mixer stage above line 10, the crush rollers stage between lines 10 and 12 and the agitation storage stage below line 12.

The kneading mixer, designated generally 14, is a Model 9D manufactured by the Farrel Company Division USM Corporation (address given above) which sells its kneading mixers under the U.S. registered trademark "Banbury". The machine has an input hopper 16 at its upper part to which the waste is supplied at intervals by conveyor 18, as indicated by directional arrow 19. Conveyor 18 is a conventional weighing type, as indicated by the weighing fulcrum 20. It may be operated to start syncronously with a signal from mixer 14 that it is ready for another batch with the hopper top open and to stop when the batch amount, nominally 200 pounds, has passed the weighing device. The waste may be provided to the conveyor in any convenient manner. It should be free of foreign matter, but need not be cut into pieces, since the machine is designed to accept rolls and bundles as well as pieces.

Figure 3:
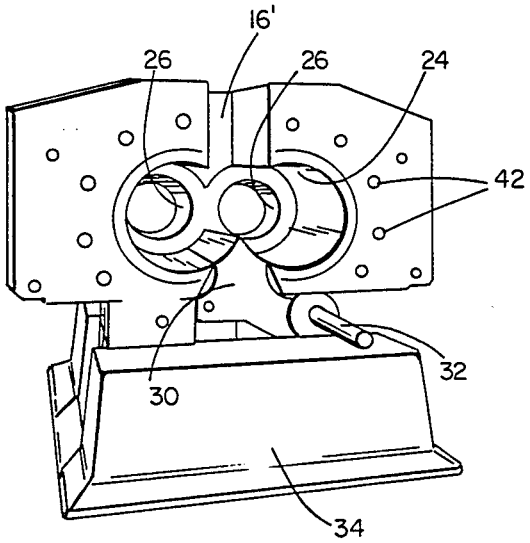
FIG. 3 is an enlarged perspective view of the lower part of the kneading mixer shown diagrammatically in FIG. 2, with parts removed to show the interior of the mixing chamber.

Hopper 16 has an internal chute 16', partially shown in FIGS. 3, which delivers the waste to the kneading-mixing chamber in the central portion 22 of the machine. (The vertically reciprocating tamper normally provided in the machine for forcing feed through the inlet chute has been omitted because it has been found to be unnecessary, but it may, of course, be included as a precaution.) As can be seen from FIG. 3, the kneading mixing chamber 24 has two axially parallel generally cylindrical sub-chambers open toward each other and at the top to form between them the lower end of chute 16'. Each sub-chamber has mounting ways 26 at each end (one set shown) for mixing rotors 28 of smaller diameter than the cylinders of chambers 24. At the lower end, the two cylinders are continued by the curved sides of an anvil 30, which terminates in an upwardly directed edge between the cylinders. Anvil 30 is mounted on pivot shaft 32 and is latched in the position shown except during the dump cycle when it is unlatched and pivoted by shaft 32 downward into machine base portion 34, out of the way so that chamber 24 can be emptied through the space which it occupied and through on open interior part of machine base portion 34, as indicated by flow arrow 36 in FIG. 2.

Figure 4:
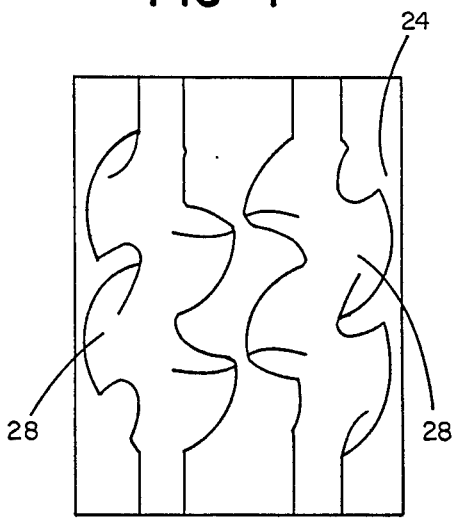
FIG. 4 is a plan view on a horizontal section through the upper part of the mixing chamber in FIG. 4, with typical mixing rotors in place.

Typical rotors 28 (FIG. 4) are oppositely rotated to force the waste downward between them against the upwardly directed edge of anvil 30, generally called the "impingement point." Each rotor drags material between itself and the adjacent cylinder wall of chamber 24, first downward and outward, then upward and outward, then upward and inward, then downward and inward to complete the cycle. The rotors are helically bladed as indicated in FIG. 4, with the paths of rotation tangent at the horizontal diameter. The rotors can overlap and be rotated so that the overlap portion of each rotor passes into the path of the other alternately. However, this produces a more vigorous action than has been found necessary for purposes of the present invention and is not used to avoid unnecessary wear of the machine. In addition to the tearing and shear forces generated at the inpingement point, which functions primarily to break down the waste, tearing, shear and frictional drag forces are generated between the rotors and the chamber walls and kneading tension forces are exerted by the blades as they pull the material against the frictional drag of the walls and as they exchange material and pull it in opposite directions.

The machine has a main motor indicated by square 38 and various controls indicated by circle 40, including a variable speed drive for motor 38 and timing controls for operating the machine on a timed batch basis, then operating the dump mechanism 30, 32 and restoring the machine to mixing operation, the rotors being continuously operated. The machine also includes an extensive heat exchange system, not shown in the drawings except that FIG. 3 shows the extensive heat sink area surrounding the outside of mixing chamber 24 provided with perforations 42 to be connected by piping in the circulating heat exchange fluid system. That system also includes connections for circulating the exchange fluid through the rotors. The heat exchange system is equipped for rapid change of the temperature of the exchange fluid, which at start-up of the machine needs to input heat to attain the desired heat range, but which soon changes to lower temperature to dissipate excess heat that operation generates in the mixing chamber.

Regulation of the temperature of the waste material in the mixing chamber is an important aspect of the invention both from the standpoint of obtaining the desired fragmentation of the glass fibers and also to provide a suitable fluid viscosity of the material for the ensuing operation of the crush rolls. It has been determined that a suitable temperature range of the material leaving the mixer is about 180° F. to about 220° F. Viscosity at this low temperature range cannot be measured with accuracy, particularly if surfacing granules are present, but has been roughly determined to be between about 400,000 and about 800,000 centipoises at 180° F. to 220° F. If the material is heated too much in the mixing chamber, it may become too liquid to transfer the mixing forces properly to the fibers and to provide an adequate shield of the surfacing granules to prevent excessive wear thereby of the mixing chamber or of the crush rollers during the subsequent crushing of the surfacing granules. Gases generated during the kneading-mixing operation are vented through a venting connection 42 at the top of hopper 16.

The time required for adequate pulverizing of the glass fiber in the mixing chamber is generally of the order of 1.5 to 5 minutes, and should not be unnecessarily long to save wear. This is generally at rotor 28 speeds of 35 to 50 revolutions per minute. The total cycle will add about 15 to 20 seconds each for completion of the feed and dumping cycles. At the mixing times indicated, glass fiber pulverizing to maximum particle dimension substantially below 0.024 inches (600 microns) is consistently obtained. In determining performance, samples of the product are ignited to completely burn the asphalt and carbon, then the residue is screened through progressively finer mesh Tyler screens. When this is done before treatment by the crush rolls, the surfacing granules screen out at greater than Tyler 28 mesh (0.024 inches 600 microns). Glass fibers pass the Tyler 6.5 mesh screen (0.008 inches (200 microns) and usually the Tyler 100 mesh screen (0.006 inches, 149 microns). Generally corresponding results are obtained with the similar Japanese manufactured kneader-mixer mentioned earlier herein.

Reference is now made to the crush roller stage, located immediately below the kneading mixer stage in FIG. 2. The two crush rollers diagrammatically shown at 50 and 52 may be the rollers of a conventional commercially available two-roll mill, equipped with frame, guards and an hydraulic system for forcing the two rollers 50 and 52 toward each other in regulated increments, none of which is indicated in the drawings, except that the micrometer control for regulating the hydraulic system to set the minimum clearance between the rollers is indicated at 54 in FIG. 5. Roller 50 is driven by a constant speed motor, indicated at 56 in FIG. 2. Roller 52 is driven by a motor indicated at 58 with variable speed drive, indicated at 60. Roller 52 is the transfer roller, being provided with a doctor mechanism indicated at 62 for removing processed material from the roller.

Figure 5:
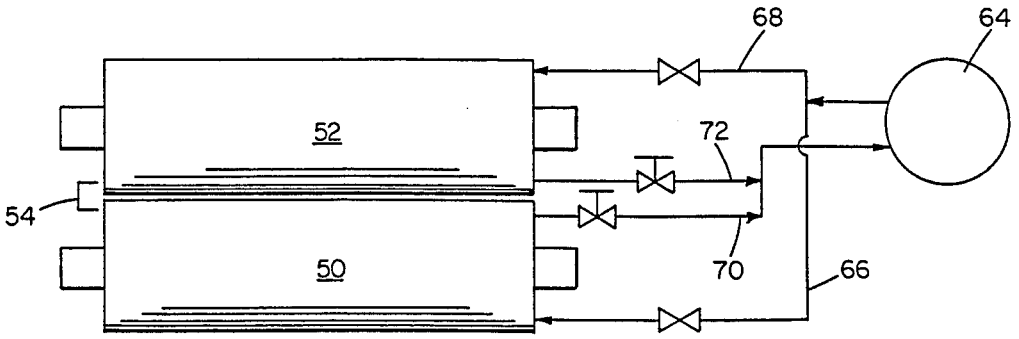
FIG. 5 is a diagrammatic plan view of the crush rollers shown in FIG. 2, with heating connections indicated.

Each roller 50, 52 is provided with an arrangement for circulating a heating fluid through it to maintain each roller at a predetermined surface temperature. In FIG. 5 such arrangement is indicated as a source 64 of heating fluid, with separately valved inlet lines 66 and 68 to rollers 50 and 52, respectively, and with separately valved return lines 70, 72, respectively. Roller surface temperature indicators are provided on a valve control panel (not shown).

Rollers 50, 52 are arranged with their axes aligned with the axes of the kneading mixing rotors 28 and with the space between roller 50, 52 centered on the discharge from the kneading mixer. Rollers 50, 52 thus form a trough into which the contents of the kneading mixer are dumped at each cycle, the material dumped being sufficiently fluid to spread along the rollers to form a substantially uniform pool, as indicated at 74 in FIG. 2. The rollers 50, 52 are continuously oppositely rotated, with the roller 52 adjusted to rotate somewhat faster than roller 50. Roller 50 is also heated to a higher temperature than roller 52, such as 170° F. for roller 50 and 150° F. for roller 52. Roller 50 may be operated at about 20 r.p.m. and roller 52 several r.p.m. faster. The rollers continually pull material from pool 74 through the minimum clearance between them, which is preset by control 54 at less than 0.024 inches (600 microns) and may preferably be about 0.008 inches (200 microns). Because roller 50 is heated to a higher surface temperature than roller 52 and rotates at slower speed, the material sticks preferentially to the surface of roller 52, from which it is removed by doctor 62. While roller 50 normally stays clean, it may be equipped with an intermittently operated doctor (not shown).

The diameter of rollers 50, 52 is such as to provide adequate space for the pool 74 above their nip. In the instance shown, their diameter was 20 inches (508 mm). Their rotation speed is selected partially on the basis that they will completely process the material pool 74 within the time period between successive dump cycles of kneading-mixer 14. In normal operation, there is only one pass of the material between the rollers. It is possible to provide more than one pass, for example, two passes, by adjusting the doctor mechanism 62 to lift away during alternate revolutions of roller 52 if fine enough crushing is not obtained in one pass. However, this necessitates increased roller speeds with increased forces and higher wear potentialities. One pass is preferred, and if it does not prove sufficient at first, it may well be correctable by providing more force in the hydraulic system to hold the rollers firmly at the selected minimum clearance. The objective here is to equal or better the specifications for maximum dimension of mineral filler used in the parent shingle manufacture, usually 100% less then 0.024 inches (600 microns), at least 95% less than 0.012 inches (300 microns).

As indicated by flow arrow 80 in FIG. 2, the fully reclaimed material, scraped from roller 52 by doctor mechanism 62, falls into agitation storage tank 82, having an agitation impeller 84 at the input side of a low intermediate wall 86. Sufficient asphalt at 400° F. is added through line 88 from a source (not shown) to the impeller side of wall 86 to provide a filler-to-asphalt balance with the horizontal mixer product of the parent shingle manufacturing process, as previously explained. The asphalt supplemented agitated material overflows wall 86 to the output side as indicated by flow arrow 89, from which it is discharged by a pump 90 to a valved pipeline 92 connected to a pipeline 94 for recycle to the manufacturing process, or, alternatively, to a valved pipeline 96 for recirculation to tank 82.

While the invention has been particularly illustrated and described as applied to shingle waste reclaim, it will be understood that it is by no means limited to such use. Indeed, the kneading mixer step can be used for reclaiming fiberglass or like brittle fiber reinforced asphalt sheet material generally. If the material contains mineral granules oversize for filler, the crush roller step can also be used.

For example, the typical shingle manufacturing process indicated in FIG. 1 is convertible, with certain readily made changes, to the manufacture of other fiberglass reinforced asphalt sheet materials used for built-up roofing. In fact, most shingle manufacturers adapt their shingle manufacturing process to the manufacture of built-up roofing materials for as much as 10% or more of their total production.

Built-up roofing material, commonly used on flat roofs, is supplied to the roofer in wide, rolled strip form of three specifically different compositions, to form different layers of the built-up roofing. These are a "base sheet" material used for the bottom layer, "ply sheet" material used to form an intermediate layer, usually of multiple sheets to provide desired thickness, and a "cap sheet" material used to form a top layer. Typical formulae for these materials, in percentages by weight, are approximately as follows.

Base sheet material—41% asphalt, 18% mineral filler, 7% fiberglass mat and 34% fine sand (maximum particle size not exceeding that of mineral filler, generally less) applied to the back surface as an anti-stick layer to facilitate unrolling.

Ply sheet material—53% asphalt, 20% fiberglass mat, 27% fine sand backing layer as in base sheet material.

Cap sheet—27% asphalt, 12% mineral filler, 4% fiberglass mat, 45% top surfacing granules of the size used on shingles, 12% fine sand backing as in base sheet material.

The waste reclaim process of the invention according to FIGS. 1 and 2 is applicable to the waste from the manufacture of these built-up roofing materials, although this waste will normally be less in amount than the shingle waste because of elimination of the shingle cutting stage. However, the crush rolls would be used as such only on the cap sheet waste, since it alone has large surfacing granules such as those of the shingles. Reclaimed waste from the base sheet and cap sheet material will simply have an increased content of mineral filler by addition of the backing layer sand, plus additional filler of the pulverized glass plus, as to the cap sheet only, crushed surfacing granules. It can be recycled to the parent manufacturing process with sufficient asphalt added to make the asphalt-filler weight ratio the same. Since the ply sheet reclaimed waste would have filler (made up of the sand backing plus the pulverized glass), it would not be recycled to the parent process, in which filler is not desired. It can, however, be stored and circulated to the shingle manufacturing process where, since it has a higher asphalt to filler ratio than that used in the shingle manufacture, it can be added in proper proportion to the agitation storage stage of the reclaim and recycle section to reduce the amount of new asphalt needed.

We claim:

1. A method for producing a reclaimed asphalt material suitable for use in the manufacture of asphalt shingles reinforced with inelastic brittle fibers such as fiberglass, said method comprising reclaiming waste asphalt sheet material reinforced with inelastic brittle fibers such as fiberglass by passing the waste material through a kneading mixer and therein subjecting the material to tearing, kneading, shear and frictional drag forces at a temperature and for a time sufficient to reduce said material to a viscous fluid state in which said fibers have been pulverized to particles of a maximum dimension less than about 600 microns.

2. A method according to claim 1 wherein said temperature is in the range about 160° F. to about 220° F.

3. A method according to claim 2 wherein said time is of the order of 1.5 to 5 minutes.

4. A method according to claim 1 wherein said maximum particle size is less than about 300 microns.

5. A method according to claim 1 wherein said material in said fluid state has a viscosity between about 400,000 and about 800,000 centipoises at 180° F. to 220° F.

6. A method according to claims 1, 2, 3, 4, 5 wherein said waste material contains mineral granules of a maximum dimension greater than 600 microns which are not substantially reduced in size by said forces, and which includes the additional steps of feeding said reduced fluid material into the nip between opposed, heated rollers having a minimum clearance less than about 600 microns, and oppositely rotating said rollers to force said fluid material through said minimum clearance and thereby to reduce said granules to a maximum dimension at least approximately as small as said clearance.

7. A method according to claim 6 in which said minimum clearance is approximately 300 microns.

8. A method according to claim 6 in which said rollers are rotated at different speeds and are heated to at least 150° F. surface temperature.

9. A method according to claim 6 wherein said waste material comprises the waste produced in the manufacture and cutting of roofing shingles and said fluid material passing between said rollers is mixed with additional asphalt of higher temperature and fed into the material process stream for the manufacture of the shingles.

10. Reclaimed waste of asphalt sheet material reinforced with inelastic brittle reinforcing fibers such as fiberglass, comprising said fibers pulverized to a maximum particle dimension of less than about 600 microns, and said asphalt.

11. Reclaimed waste according to claim 11 wherein said maximum particle dimension is less than about 300 microns.

12. Reclaimed waste according to either of claims 10 or 11 which also comprises mineral filler of a maximum particle size less than about 600 microns.

13. Reclaimed waste according to claim 12 wherein said mineral filler comprises mineral granules of larger maximum dimension contained in said waste crushed to said maximum dimension.

14. Reclaimed waste according to claim 13 wherein at least 95% of said crushed mineral granules are of maximum dimension less than about 200 microns.

* * * * *